US005732675A

United States Patent [19]

Yoshida et al.

[11] Patent Number: 5,732,675

[45] Date of Patent: Mar. 31, 1998

[54] AIR/FUEL RATIO CONTROL APPARATUS FOR DIRECT INJECTION ENGINE

[75] Inventors: Yoshiyuki Yoshida; Kousaku Shimada, both of Hitachinaka, Japan

[73] Assignee: Hitachi, Ltd., Japan

[21] Appl. No.: 788,567

[22] Filed: Jan. 24, 1997

[30] Foreign Application Priority Data

Feb. 9, 1996 [JP] Japan ..... 8-024284

[51] Int. Cl.[6] ..... F02B 5/00; F02D 31/00

[52] U.S. Cl. ..... 123/305; 123/494; 123/357

[58] Field of Search ..... 123/305, 478, 123/480, 494, 357

[56] References Cited

U.S. PATENT DOCUMENTS

| | | | |
|---|---|---|---|
| 4,493,302 | 1/1985 | Kawamura | 123/357 |
| 4,862,853 | 9/1989 | Tsukamoto et al. | 123/357 |
| 5,127,378 | 7/1992 | Ito | 123/305 |
| 5,289,812 | 3/1994 | Trombley et al. | 123/533 |
| 5,333,583 | 8/1994 | Matsuura | 123/305 |
| 5,485,822 | 1/1996 | Hirose et al. | 123/357 |

FOREIGN PATENT DOCUMENTS 62-186034 8/1987 Japan .

*Primary Examiner*—Thomas N. Moulis

*Attorney, Agent, or Firm*—Evenson, McKeown, Edwards & Lenahan, P.L.L.C.

[57] ABSTRACT

A control unit 15 of an air/fuel ratio control apparatus according to the present invention takes in signals output from various sensors detecting operational states of an engine, and controls the fuel injection amount and the ignition timing by executing the predetermined processing by using the taken-in signals, and outputting control signals obtained by the processing to each injector and an ignition coil connected to each ignition plug. Further, the amount to be injected in each cylinder is corrected, based on the integration value of fuel pressure changes detected by the fuel pressure sensor, on the basis of the found fact that the integration value of the fuel pressure changes for each cylinder well corresponds to the amount actually injected into the cylinder.

5 Claims, 8 Drawing Sheets

A/F : AIR/FUEL RATIO

AIR/FUEL RATIO CONTROL APPARATUS FOR DIRECT INJECTION ENGINE

BACKGROUND OF THE INVENTION

1. Field of the Invention

The present invention relates to a control system for a multi-cylinder combustion engine, in which fuel is directly injected into each of the cylinders, especially to an air/fuel fuel ratio control apparatus for a multi-cylinder engine in which a highly accurate air/fuel ratio control for each cylinder is required.

2. Description of Related Art

As a gasoline engine of a car, an engine of a fuel injection type has been used. Further, in the fuel injection type engine, the so-called intake port injection engine has been dominantly used.

Furthermore, recently, the so-called direct injection engine in which fuel is directly injected into each cylinder, has been attended to, from the view points of high power and low fuel consumption, further, compatible with clean exhaustion gas.

The great attention to the direct injection engine is because the direct injection engine is favorable to operations with a lean air/fuel ratio mixture that is required for the low fuel consumption and the clean exhaustion gas.

That is, by using the direct injection engine, the stable combustion can be realized, since by a slewing flow generated by intake air, the fuel spray injected into a cylinder is atomized, and the air-fuel mixture is stratified in a combustion chamber.

The amount of fuel to be injected from each injector into each cylinder has been calculated by using the operational characteristic parameters of each injector, the egging load, etc., for the direct injection engine, likely to the intake port injection engine.

From the view point of the highly accurate control required for the lean air/fuel ratio operations, it is desirable to execute calculation of the fuel amount to be injected for each of the cylinders, and control each injector, based on the calculated fuel amount to be injected into each of the cylinders. As mentioned above, the operational characteristic parameters of each injector needs to be used for controlling each injector.

As the operational characteristic parameters of the injectors, a value, for example, the central value of values as to a respective operational parameter of an injector, which are scattering among many products of injectors, is commonly set to all the injectors used in a car.

However, there are differences among the operational characteristics of injectors, namely, component variations, caused by divergence in the characteristics of each of parts composing each injector. Since the operational characteristics of each injector have variations within an allowable limit, it is inevitable that the fuel flowing characteristics of an individual injector have also some divergence.

Further, since changes of the operational characteristics are also caused by property changes with the passage of time, for example, deposition of carbon to an injector, the operational characteristic parameters of each injector is also time-variant.

As mentioned above, the used respective injectors have the different operational characteristics which also change with the passage of time. Therefore, if the divergence and the time-variations in the operational characteristics of each injector are not taken into account, the differences among the actually injected fuel amounts of the cylinders are caused even for the same demand of a fuel amount to be injected, which also causes the scattering among the air/fuel ratios of the cylinders. By such a control of the injection amount in each cylinder, it is impossible to attain the highly accurate air/fuel ratio control under the conditions of a very lean air/fuel ratio.

As one of measures for improving the accuracy of the air/fuel ratio control, a control system for correcting the fuel amount to be injected, is disclosed in JP-A-186034/1987. In the system, the actual injection amount is estimated by using pressure changes of fuel fed to each injector, and an injection amount used for the control of each injector is corrected, based on the estimated actual injection amount.

Since the above-mentioned control system has not sufficiently improve the accuracy of estimating the actual injection amount on the basis of fuel pressure changes, there has been left a room to further improve the air/fuel ratio control of each cylinder.

That is, since it is considered that taking only the fuel pressure changes into account for estimating the actual fuel injection amount is an origin of a limit to improving the accuracy of the air/fuel ratio control, there is a large room to further improve the air/fuel ratio control of each cylinder.

SUMMARY OF THE INVENTION

An objective of the Invention

An objective of the present invention is to provide a control apparatus for a direct injection engine, for performing the highly accurate air/fuel ratio control in which variations among the air/fuel ratios of a plurality of cylinders are suppressed by executing such a control that variations among the fuel injection amounts in the cylinders, caused by the individual variations and the time-variations of the operational characteristics of the injectors, are suppressed.

Methods Solving the Problem

The above-mentioned objective of the present invention is attained by providing an air/fuel ratio control apparatus for a direct injection multi-cylinder engine, comprising:

- injection amount calculation means for calculating a reference fuel injection amount used as a reference amount for determining a fuel injection amount into each cylinder, corresponding to operational states of said engine;
- actual injection amount estimation means for estimating an actual fuel injection amount into each cylinder, based on an integration value of fuel pressure changes during a period of injecting fuel into at least one of the cylinders; and
- injection amount correction means for correcting the reference fuel injection amount calculated by the injection amount calculation means, based on the estimated actual fuel injection amount.

By using the above-mentioned air/fuel ratio control apparatus, the actual fuel injection amount can be accurately estimated, and the final fuel injection amount can be adequately determined by correcting the reference fuel injection amount with a correction amount used for compensating variations among the air/fuel ratios of the installed cylinders, which are caused by the divergence of the operational characteristics of the injectors into account, based on the reference injection time width and the estimated actual fuel injection amount. Thus, it is possible by using the air/fuel ratio control apparatus according to the present invention, to realize the highly accurate air/fuel ratio control by suppressing the variations among the air/fuel ratios of the cylinders.

DETAILED DESCRIPTION OF THE EMBODIMENTS

Figure 1:
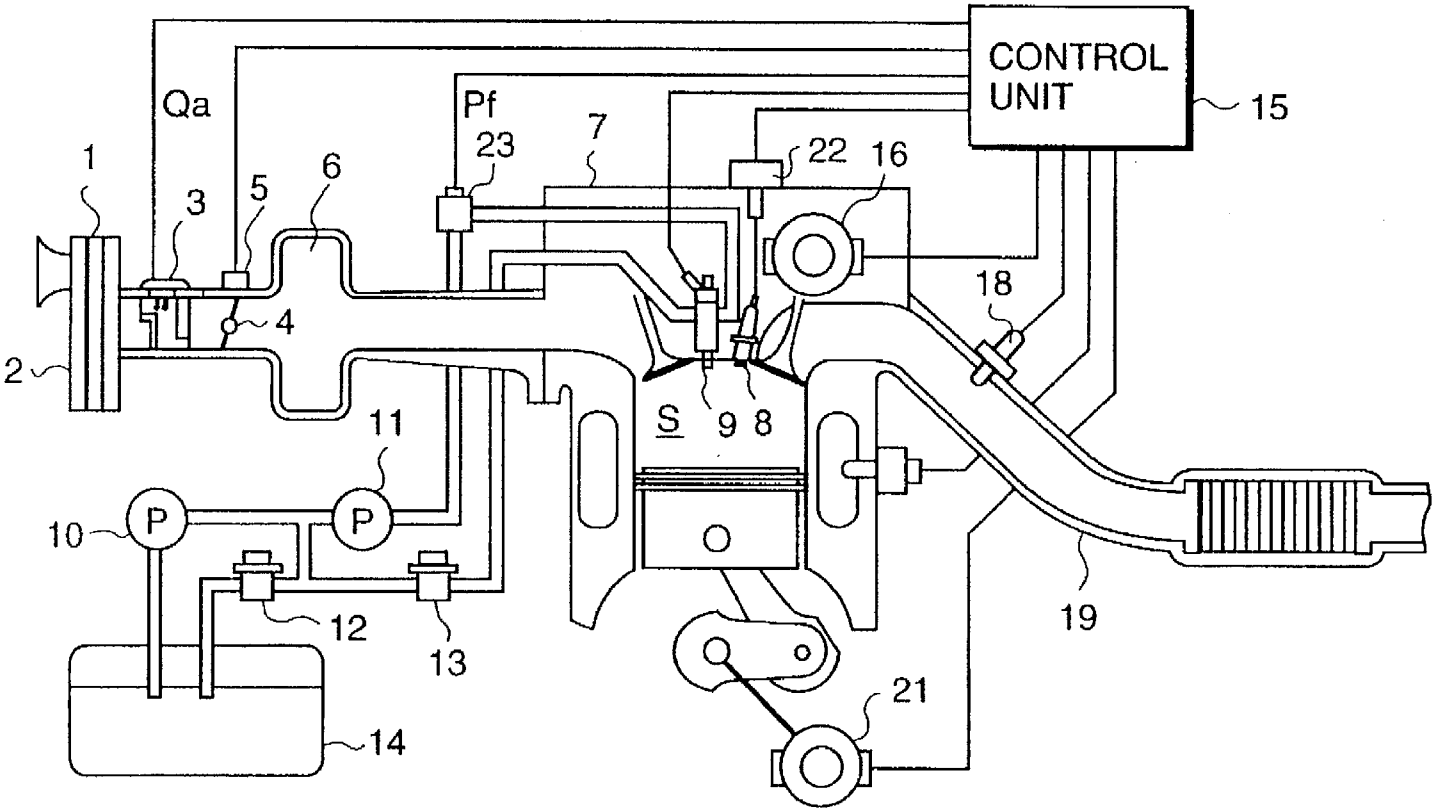
FIG. 1 shows a composition of an engine system to which an air/fuel ratio control apparatus for a direct injection engine of an embodiment according to the present invention is applied.

Hereinafter, details of the present invention will be explained with reference to embodiments shown in the drawings.

FIG. 1 shows a composition of an engine system to which an embodiment of the present invention is applied. In the figure, Air taken in by an engine 7 is input to a inlet part of an air cleaner 1, flows through an air flowmeter 3 and a throttle body in which a throttle valve 4 for controlling the amount of intake air, is installed, and enters a collector 6. The air which has entered the collector 6 is further distributed to intake pipes, each of the intake pipes being to connected to each cylinder of the engine 7.

At the throttle valve 4, a throttle valve opening sensor 5 is provided. The opening of the throttle valve 4 is detected or calculated, based on a signal from the throttle valve opening sensor 5, and input to a control unit 15.

Fuel such as gasoline stored in a fuel tank 14 is first pressurized by a fuel pump 10, and its pressure is regulated to a constant pressure, for example, 5 kg/cm$^2$ by a regulator 12 for a low level pressurization. Next, the fuel is further pressurized by a fuel pump 11, and its pressure is regulated to a higher constant pressure, for example, 50 kg/cm$^2$ by a regulator 13 for a high level pressurization. Further, the pressurized fuel is fed to a fuel system to which the piping of each injector 9 is connected.

Furthermore, the fuel is injected from an injector provided at each cylinder into the cylinder.

In the fuel system to which the piping of each injector 9 is connected, a fuel sensor 23 is provided, and by the fuel sensor 23, a signal Pf of the fuel pressure in a fuel pipe of each injector 9 is detected, and input to the control unit 15.

Moreover, a signal Qa of the intake air flow rate is output from the air flowmeter 3, and also input to the control unit 15.

A crank angle sensor 16 is provided at each cam shaft of the engine 7, and the sensor 16 outputs a reference angle signal REF showing a position of each crank shaft in a revolution, and a angle signal POS used for detecting a revolution speed of each crank which are input to the control unit 15. It is also available to use a crank angle sensor of another type sensor 21 directly detecting the revolution speed, in the place of the crank angle sensor 16.

In an exhaustion pipe 19, an air/fuel ratio sensor 18 is provided, and a signal of the air/fuel ratio detected by the sensor 18 is also input to the control unit 15.

The control unit 15 takes in signals output from the above-mentioned various sensors detecting operational states of the engine, and controls the fuel injection amount (hereafter, simply described as the injection amount) and the ignition timing, by executing the predetermined processing with the taken-in signals, and outputting control signals obtained by the predetermined processing, to each injector 9 and an ignition coil 22 connected to each ignition plug 8.

In the embodiment, the amount to be injected in each cylinder is corrected on the basis of the fuel pressure changes detected by the fuel pressure sensor 23. Because it was found that the integration value of the fuel pressure changes in each cylinder well corresponds to the amount actually injected in the cylinder, the amount to be injected in each cylinder is corrected, based on the integration value of the fuel pressure changes in each cylinder, in the present invention.

Figure 2:
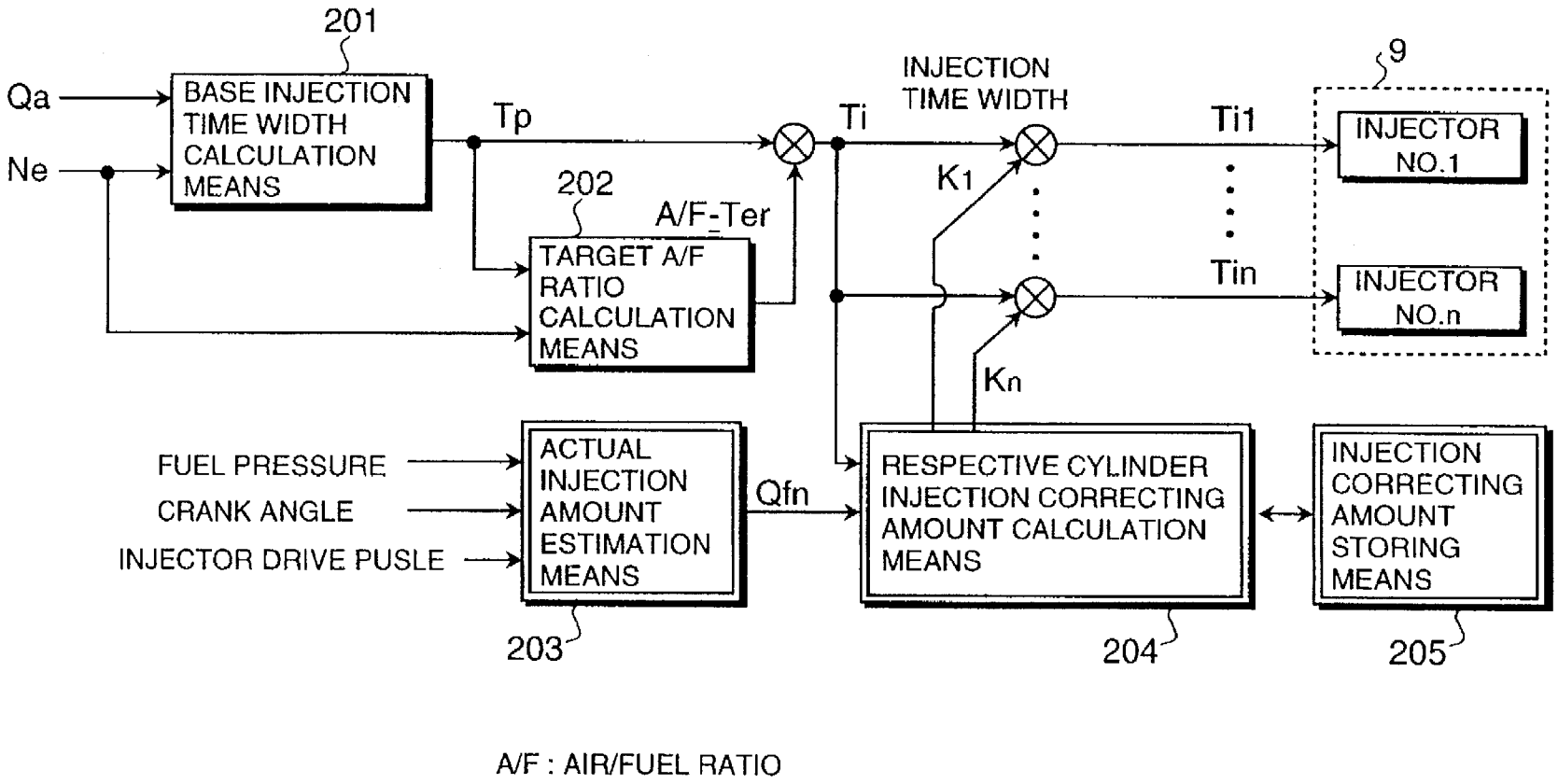
FIG. 2 is a block diagram showing a composition of the air/fuel ration control apparatus for a direct injection engine of the embodiment shown in FIG. 1.

FIG. 2 shows a block diagram of control processing in the embodiment according to the present invention. At first, a base injection time width calculation means 201 calculates a base injection time width Tp, by using a function or a prepared map, in each of which the base injection time width is expressed by two variables of the intake air flow rate Qa and the engine speed Ne.

Next, a target air/fuel (A/F) ratio calculation means 202 calculates a target A/F ratio A/F_Ter, by using a function or a prepared map, in each of which the target A/F ratio A/F_Ter is expressed by two variables of the base injection time width Tp and the engine speed Ne.

Further, by using the calculated base injection time width Tp and the calculated target A/F ratio A/F_Ter, an injection time width Ti is determined for each cylinder, corresponding to operational states of the engine.

An actual injection amount estimation means 203 estimates an actual injection amount Qfn, by means of calculation of a function or searching a map, by using the fuel pressure Pf which is detected by the fuel sensor 23 or estimated from the detected signal, the detected reference crank angle REF used for determining a position of each crank shaft in a revolution, and the injector drive pulse signal for controlling each injector.

Further, by a respective cylinder injection correcting amount calculation means 204, correction amounts K1, . . . , K n−1, and Kn, are obtained so as to satisfy the required target A/F ratio by using the above-mentioned injection time width Ti and the estimated actual injection amount Qfn, while taking the divergence of the operational characteristics of the injectors into account.

Thus, each of the final injection time widths Ti1, . . . , Ti n−1, and Tin, is obtained by correcting the injection time width Ti with each correction faction factor Kn (n=1,2, . . . m), and used for controlling each injector. By using the above-mentioned corrected injection time width, the divergence of the operational characteristics of the injectors are compensated, and the required target A/F ratio can be realized for each cylinder.

The respective correction amount Kn (n=1,2, . . . m) obtained by the respective cylinder injection correcting amount calculation means 204, is stored in a correction amount storing means 205 until each of the correction amounts is changed or renewed, for example, by a learning means.

As the correction amount storing means 205, a non-volatile and electrically rewritable memory, a back-up RAM and so forth are used.

In the embodiment, since the respective correction amount Kn (n=1, . . . , m) for the injector No. n is obtained by using the injection time width Ti and the estimated actual injection amount Qfn, it is possible to suppress influences of the divergence of the operational characteristics of components such as injectors, on the A/F ratio of each cylinder. Further, it is possible to compensate the divergence among the A/F ratios of the cylinders, by learning the optimal correction amount Kn (n=1, . . . , m) even if the operational characteristic changes of the injectors are caused by the aged deterioration or an anomaly occurrence. Therefore, by applying the embodiment, it becomes possible to secure the highly accurate A/F ratio control easily, and realize a anomaly detection function (fail safe function) of an injector system by checking changes of the correction amounts Kn (n=1, . . . , m).

Figure 3:
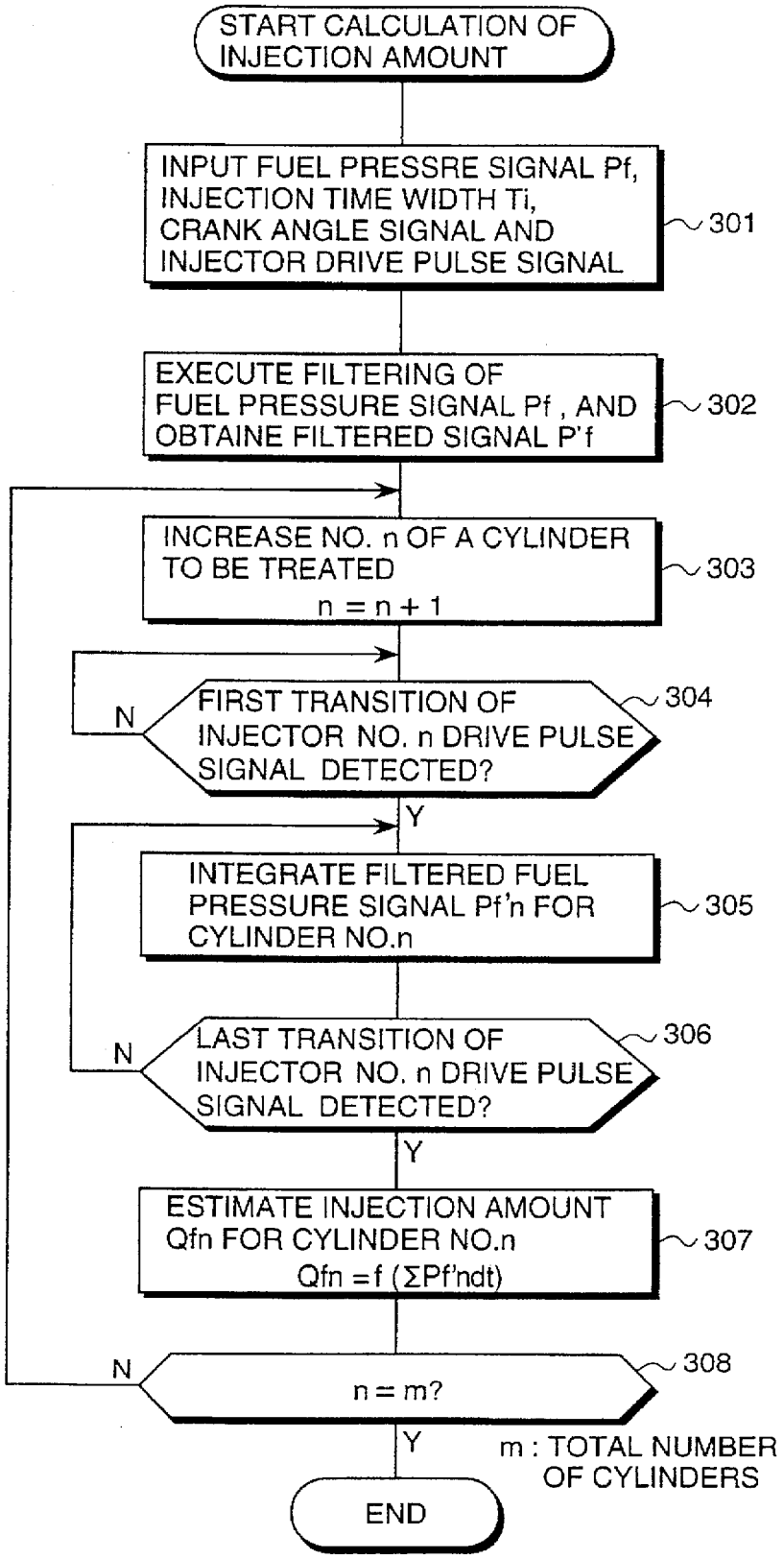
FIG. 3 is a flow chart for explaining the processing executedby an actual fuel injection estimation means included in the embodiment.

In the following, the processing executed by the actual injection amount estimation means 203 is explained by referring to the flow chart shown in FIG. 3.

At first, at step 301, the fuel pressure Pf which is detected by the fuel pressure sensor 23, or calculated by using the detected signal, the detected crank angle for each cylinder, and the injector drive pulse signal for each injector, are taken in.

At step 302, the fuel pressure signal Pf is filtered in order to remove noise components of the signal Pf, such as a pulsating change component caused by the volume capacitance of the fuel system, a component caused by fluctuating changes of the engine speed, etc., and a filtered pressure change waveform Pf' is obtained.

At step 303, a cylinder No. n (n=1, . . . , m) to which the injection time width is to be determined, is designated.

If each injection time width is to be determined in the order of the first cylinder to the n-th cylinder, the number of the cylinder to which the injection time width is to be determined, is set as 0 before the processing shown the flow chart is started.

Further, by using the first and last transition of the injector drive pulse for the designated cylinder No.n detected at steps 304 and 306, as trigger timings for the calculation start and stop, respectively, the integration value ∫Pf'n dt is obtained by integrating the filtered fuel pressure changes Pf'n, at step 305.

As mentioned above, during the time interval (=the injection time width) of the ON state (high level) of the injector drive pulse, the integral processing of the fuel pressure changes is executed.

At step 307, the actual injection amount Qfn is estimated, by means of calculation of a function or searching a data table, by using the obtained integration value ∫Pf'n dt.

At steps 303 to 308, the above-mentioned processing is repeated m times until the number n of the designated cylinder reaches m, and in each repetition of the processing, the actual injection amount Qfn is estimated for the cylinder No.n.

In the following, the processing executed by the actual injection amount estimation means 203 is explained by referring to the time chart shown in FIG. 4.

At first, the integration value ∫Pf'1 dt is calculated by starting the integration of the filtered fuel pressure signal Pf'1 at the first transition point "a", and ending the integration at the last transition point "b", of the injector No.1 drive pulse signal for the cylinder No.1.

In the same manner, the integration of the fuel pressure changes is executed for each of the remaining cylinders, according to the order of the cylinder into which fuel is to be injected, for example, in the case that fuel is next to be injected into the cylinder No.2, the integration value ∫Pf'2 dt is calculated by starting the integration of the filtered fuel pressure signal Pf'2 at the first transition point "c" and ending the integration at the last transition point "d", of the injector No.2 drive pulse signal for the cylinder No.2.

Figure 4:
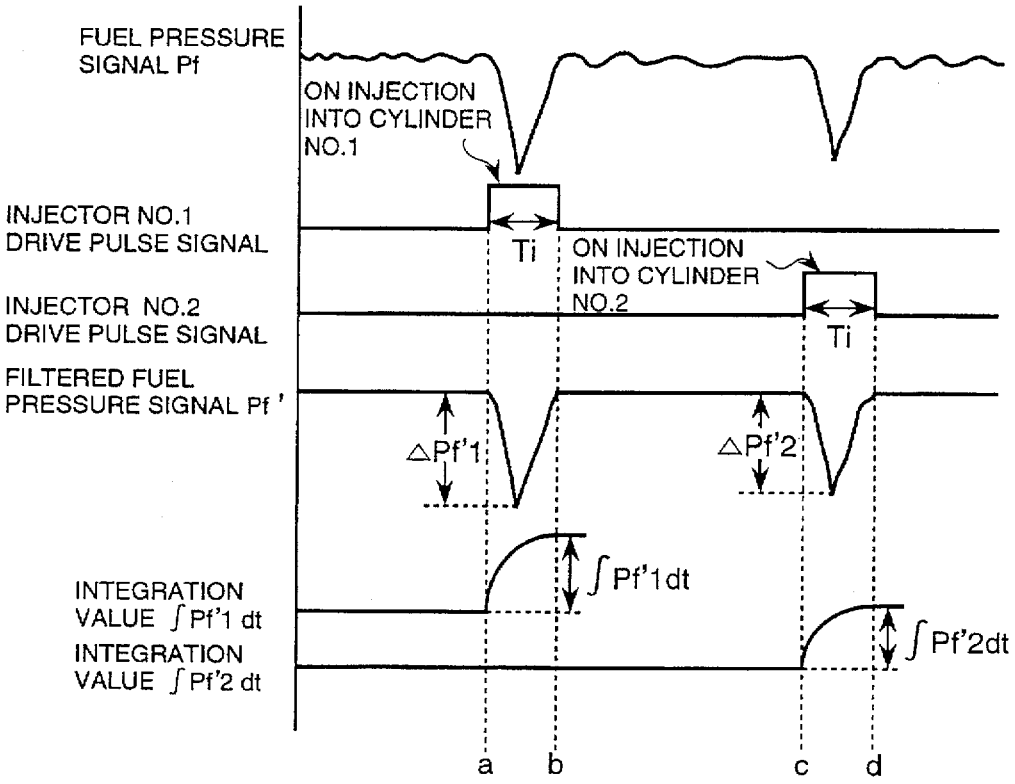
FIG. 4 is a time chart for explaining operations of the actual fuel injection estimation means included in the embodiment.

Now, although the actual injection amount Qfn is estimated by using the integration value ∫Pf'n dt for compensating the divergence among the operational characteristics of the injectors in the embodiment, it is also available to estimate the actual injection amount Qfn by using the peak value ΔPf'n in the changes of the fuel pressure Pf'n, or the combination of ΔPf'n and Pf'n, as shown in FIG. 4.

However, since the actual injection is continued during the time interval of a high level state of the injector drive pulse, the actual injection amount depends on not only the peak value ΔPf'n of the fuel pressure changes but also mainly the integration value ∫Pf'n dt indicating an area of the fuel pressure changes, the changes being caused by every fuel injection into each cylinder.

Therefore, in the embodiment, the actual injection amount is estimated by using the integration value ∫Pf'n dt, which makes it possible to obtain the actual injection amount for each cylinder, and suppress influences of the divergence in the A/F ratios of the cylinders.

Figure 5:
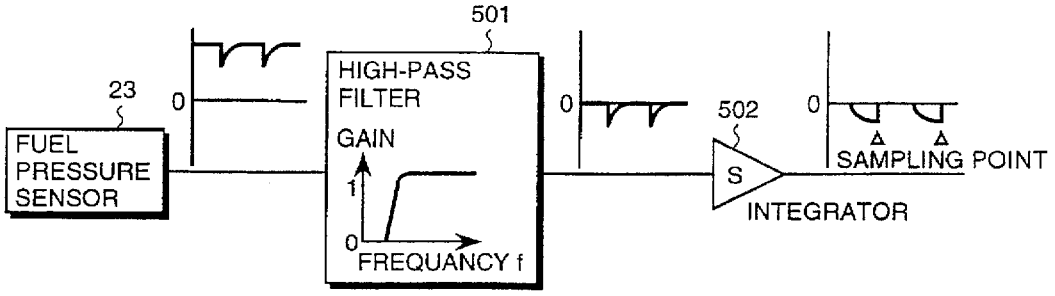
FIG. 5 is a block diagram showing a composition of an integration means included in the embodiment.

In the following, an example of the integral processing executed at step 305 is explained by referring the block diagram shown in FIG. 5.

At first, the fuel pressure signal Pf output from the fuel pressure sensor 23 is input to a high-pass filter 501, and the filter 501 extracts the component of the fuel pressure changes generated only by each injection, by removing the direct current component and noise components of the fuel pressure signal which are caused by pulsating flow changes due to a piping capacitance of the fuel system and changes of the engine speed.

Next, the changing component extracted by the filter 501 is integrated by an integrator 502, and the integration value of the integrator 502 is sampled at a predetermined period.

Further, the predetermined sampling period is set so as to synchronize with the injector drive pulse.

Figure 6:
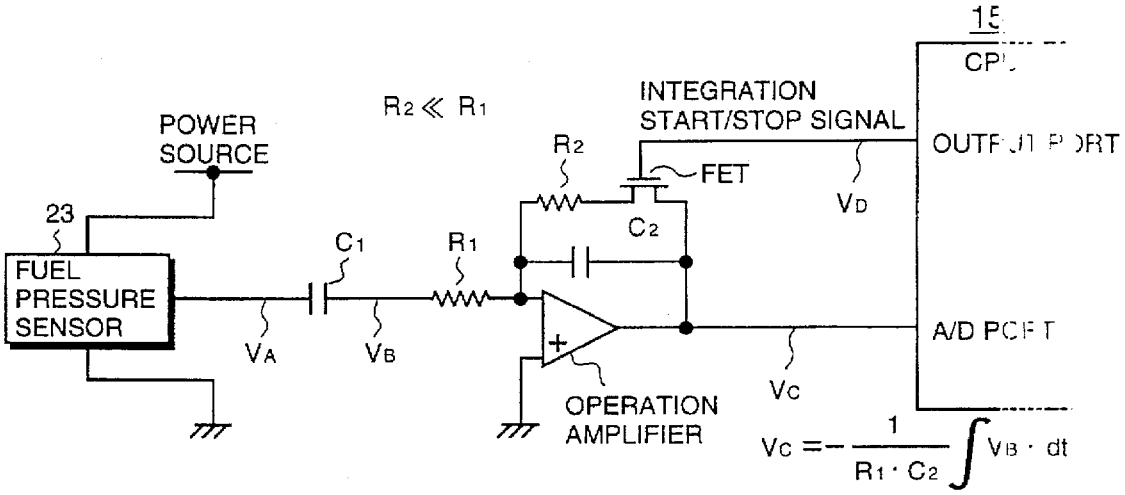
FIG. 6 shows an example of an integrator incorporated in the integration means of the embodiment.

Moreover, an example of the integrator 502 in which the integral processing means is realized by using an electrical circuit, is explained by referring to FIG. 6.

In FIG. 6, at first, the voltage $V_A$ of the fuel pressure signal output from the fuel pressure sensor 23 is input to a capacitor $C_1$, and the capacitor $C_1$ extracts the component of the fuel pressure changes generated only by the fuel injection for each cylinder, namely, the voltage $V_B$, by removing the direct current component of the fuel pressure signal.

Next, the voltage $V_B$ is input to an integral circuit composed of a resistor $R_1$, an operation amplifier and a capacitor $C_2$, and the voltage integration value $V_C$ is obtained as shown in the following equation.

$$V_C=\{-1/(R_1.R_2)\}\cdot\int V_B dt \quad (1)$$

Further, in the integral circuit, a reset circuit composed of the resistance $R_2$ and a transistor FET is provided, and a start/stop signal $V_D$ for controlling the start/stop of the integral processing is sent from an output port of a CPU in the control unit 15 to the gate of the transistor FET.

By the above-mentioned composition of the integral circuit, in the OFF state of the transistor FET, which is controlled by the signal $V_D$, the voltage integration value $V_C$ is output from the integral circuit, and in the ON state of the transistor FET, the charged particles accumulated in the capacitor $C_2$ is discharged via the resistor $R_2$, and the integral circuit is reset.

The above-mentioned voltage integration value $V_C$ is input to an analog to digital conversion (D/A) port of the CPU, and used as the data expressing the integration value of the fuel pressure changes for each injection, for estimating the actual injection amount by the control unit.

Figure 7:
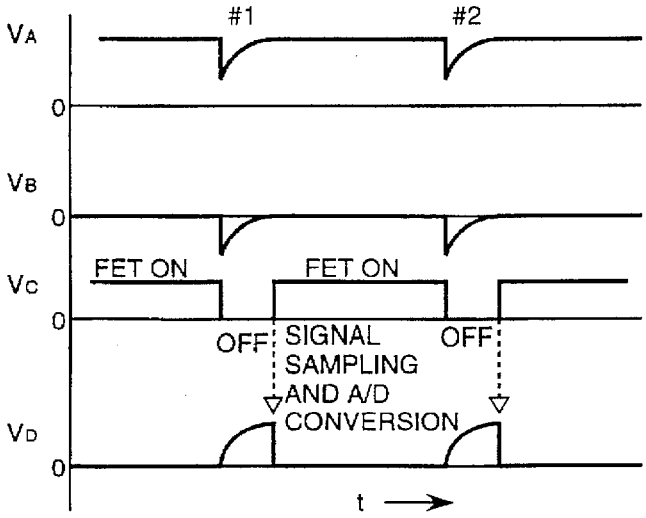
FIG. 7 is a time chart for explaining operations of the integrator.

FIG. 7 is the time chart showing operations of the integral circuit shown in FIG. 6, and the voltage $V_A$ indicating the fuel pressure, output from the fuel pressure sensor 23, is converted to the voltage $V_B$ indicating the changing component generated by only each injection, and the voltage $V_B$ is integrated by the integral circuit.

The start/stop signal $V_D$ is generated and output by the CPU in the control unit 15, synchronizing with the generation of each injector drive pulse, and used to perform the ON/OFF control of the transistor FET.

During the OFF state of the transistor FET, the voltage $V_B$ is integrated, and the voltage integration value $V_C$ is sampled by the CPU at the transition point from OFF state to ON state of the pulse, and simultaneously the integral circuit is reset.

Figure 8:
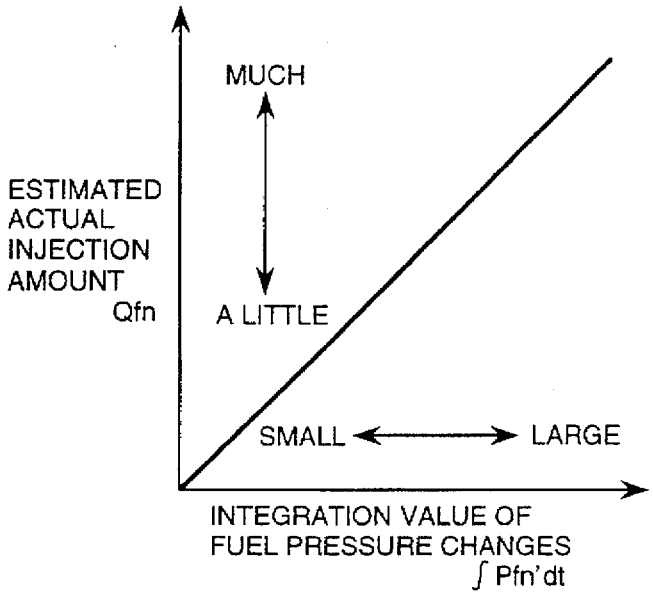
FIG. 8 is a graph for explaining the contents of a data table used for estimating the actual fuel injection amount Qfn in the embodiment.

FIG. 8 shows an example of a data table used for estimating the actual injection amount Qfn in the actual injection amount estimation means 203. In the example, the data table stores a relation between the estimated actual injection amount and the integration value ∫Pf' dt, wherein the amount actually injected in a cylinder is estimated as small at the region in which the pressure changing amount is small and the integration value ∫Pf' dt is also small, and the amount actually injected in a cylinder is estimated as large at the region in which the pressure changing amount is large and the integration value ∫Pf' dt is also large.

Figure 9:
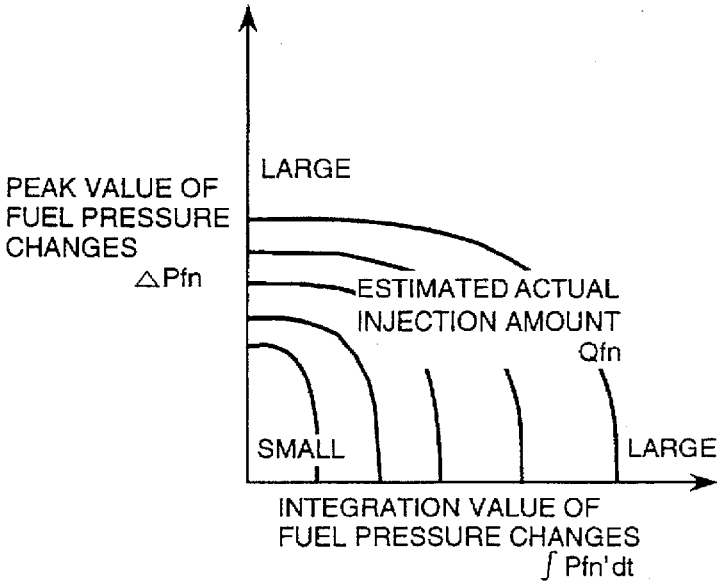
FIG. 9 is a graph for explaining the contents of another data table used for estimating the actual fuel injection amount Qfn in the embodiment.

FIG. 9 shows an example of a data map used for estimating the actual injection amount Qfn in the actual injection amount estimation means 203. In the example, the data map expressed by two variables of the downward peak value ΔPf'n and the integration value ∫Pf'n dt of the fuel pressure changes during the time interval of the fuel injection continued by each injector driven by the injector drive pulse.

In the example, if both the values of the downward peak value ΔPf'n and the integration value ∫Pf'n dt of the fuel pressure changes are small, the actual injection amount Qfn is estimated as small, and on the contrary, if both the values are large, the actual injection amount Qfn is estimated as large.

Further, since the integration value ∫Pf'n dt of the fuel pressure changes more largely reflects the actual injection amount Qfn than the downward peak value ΔPf'n, the larger weight is applied to the integration value ∫Pf'n dt.

Figure 10:
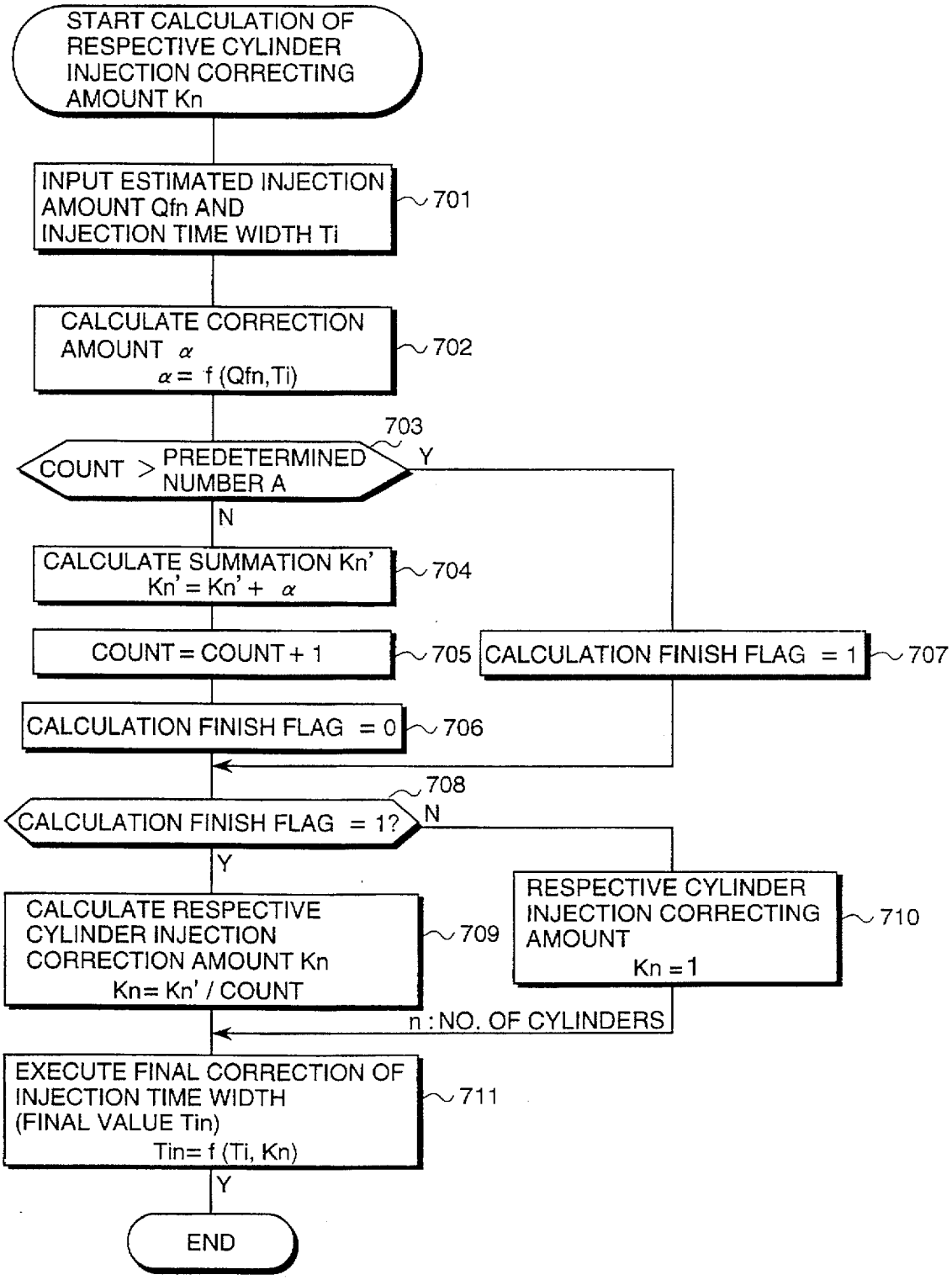
FIG. 10 is a flow chart for explaining the processing executed by a respective cylinder injection correcting amount calculation means for calculating each correction amount Kn, included in the embodiment.

In the following, the calculation processing of the correction amount Kn, executed by the respective cylinder injection correcting amount calculation means 204 is explained by referring to the flow chart shown in FIG. 10.

First, at step 701, the estimated actual injection amount Qfn and the injection time width Ti are taken in.

Next, at step 702, a correction increment α is obtained, by means of calculation of a function or searching a data table, by using the estimated actual injection amount Qfn and the injection time width Ti.

Further, at step 703, the present repetition number COUNT is compared with the predetermined repetition number A for renewing the correction amount Kn. If the number COUNT is not more than the number A, at step 704, the obtained correction increment α is added to the previous sum Kn', further at step 704, the number COUNT is increased by one, and at step 706, "0" is set to a finish flag for determining a renewal of the correction amount Kn and outputting the renewed correction amount Kn.

On the contrary, if the number COUNT is more than the number A, at step 707, "1" is set to the finish flag.

Further, at step 708, the value of the flag is checked, and if the value of the flag is "1", at step 709, the average value of Kn is obtained by dividing the final sum Kn' by the number COUNT (=A), and the average value of Kn is set as the renewed correction amount Kn for the cylinder No. n.

If the number COUNT is not more than the number A, that is, the value of the finish flag is not "1", at step 710, the value of the correction amount Kn is left as "1".

Further, at step 711, the final injection time width Tin corresponding to the width of the injector drive pulse actually controlling the injector No.n is obtained by using the correction amount Kn for the cylinder No.n and the injection time width Ti.

In the embodiment, in the case that the correction amount Kn is 1, the final injection time width Tin is set as Ti.

Figure 11:
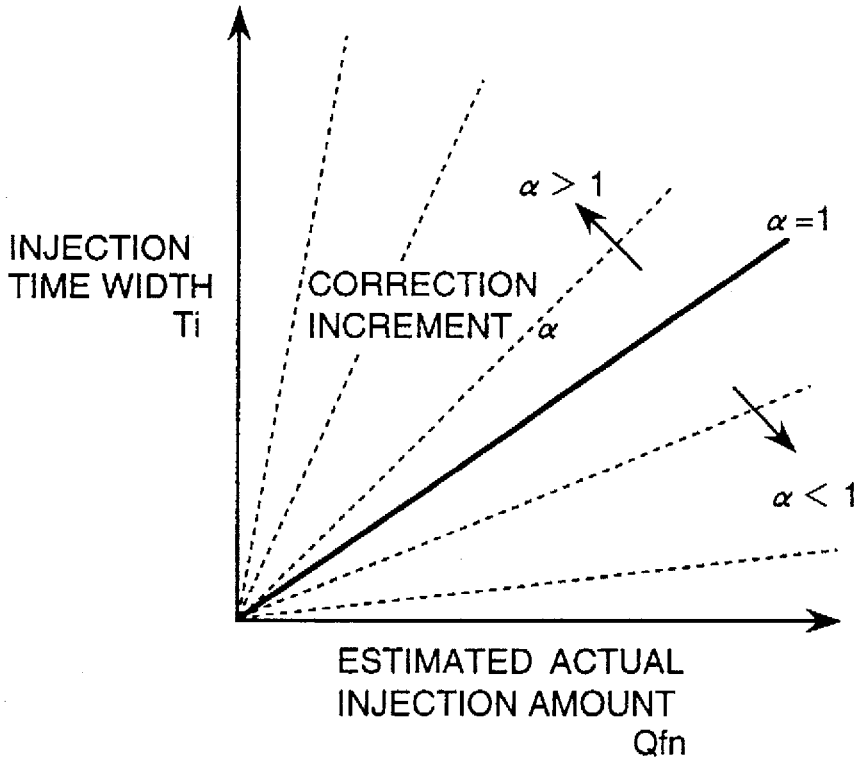
FIG. 11 is a graph for explaining the contents of a data table used for calculating a correction increment $\alpha$ in the embodiment.

FIG. 11 shows an example of a data map used for calculating the correction increment α in the respective cylinder injection correcting amount calculation means 204. In the embodiment, the data map, for example, obtained as follows, is used. That is, an injector was selected as a reference injector, and a relation between the actual injection amount and the injection time width was empirically obtained as to the reference injector. Further, in any point of the data map, satisfying the obtained relation, the correction increment α is set as "1.0".

Furthermore, in the area in which the actual injection amount Qfn is more than the amount to be predicted by the relation, corresponding to the injection time Ti, the injection amount is adjusted by setting the correction increment α as less than 1.0, so that the final injection time width Tin is less than the injection time width Ti.

On the contrary, in the area in which the actual injection amount Qfn is less than the amount to be predicted by the relation, corresponding to the injection time Ti, the injection amount is adjusted by setting the correction increment α as more than 1.0, so that the final injection time width Tin is more than the injection time width Ti.

By applying the present invention, the final injection time width for each cylinder is determined by using the correction amount for each cylinder which is obtained by taking the divergence among the operational characteristics of the installed injectors into account, based on the injection time width and the estimated actual fuel injection amount for each cylinder. Thus, it is possible by using the air/fuel ratio control apparatus according to the present invention, to realize the highly accurate air/fuel ratio control by suppressing the variations among the air/fuel ratios of the installed cylinders.

What is claimed is:

1. An air/fuel ratio control apparatus for a direct injection multi-cylinder engine, comprising:

injection amount calculation means for calculating a reference fuel injection amount used as a reference amount for determining a fuel injection amount into each of said cylinders, corresponding to operational states of said engine;

actual injection amount estimation means for estimating an actual injection amount into each cylinder, based on an integration value of fuel pressure changes during a period of injecting fuel into at least one of said cylinders; and injection amount correction means for correcting said reference fuel injection amount calculated by said injection amount calculation means, based on said estimated actual fuel injection amount.

2. An air/fuel ratio control apparatus for a direct injection multi-cylinder engine according to claim 1, wherein said actual injection amount estimation means estimates said actual fuel amount into each cylinder, based on the integration value of fuel pressure changes during a period of injecting fuel into said corresponding cylinder, and said injection amount correction means corrects said reference fuel injection amount calculated by said injection amount calculation means, based on said actual fuel injection amount estimated for said corresponding cylinder, in order to determine an injection fuel injection amount particular to each cylinder.

3. An air/fuel ratio control apparatus for a direct injection multi-cylinder engine according to claim 1, wherein said actual injection amount estimation means estimates said actual fuel injection amount into each cylinder, by searching a map in which an actual fuel injection amount is expressed by two variables of a peak value and an integration value of fuel pressure changes generated by only an fuel injection.

4. An air/fuel ratio control apparatus for a direct injection multi-cylinder engine according to claim 1, wherein said estimated actual fuel injection amount is obtained by averaging a plurality of actual fuel injection amounts estimated for a plurality times of fuel injections.

5. An air/fuel ratio control apparatus for a direct injection multi-cylinder engine according to claim 1, wherein said estimated actual fuel injection amount is calculated at every predetermined sampling period.

* * * * *